US008079697B2

(12) United States Patent
Niekawa

(10) Patent No.: US 8,079,697 B2
(45) Date of Patent: Dec. 20, 2011

(54) INKJET RECORDING APPARATUS AND INKJET RECORDING METHOD

(75) Inventor: Yukihiro Niekawa, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 925 days.

(21) Appl. No.: 12/089,582

(22) PCT Filed: Oct. 10, 2006

(86) PCT No.: PCT/JP2006/320170

§ 371 (c)(1),
(2), (4) Date: Apr. 8, 2008

(87) PCT Pub. No.: WO2007/043507

PCT Pub. Date: Apr. 19, 2007

(65) Prior Publication Data

US 2009/0231404 A1 Sep. 17, 2009

(30) Foreign Application Priority Data

Oct. 14, 2005 (JP) ..... 2005-299997

(51) Int. Cl.
*B41J 2/01* (2006.01)

(52) U.S. Cl. ..... 347/102; 347/8

(58) Field of Classification Search ..... 347/102, 347/104, 14, 16, 5, 8
See application file for complete search history.

(56) References Cited

U.S. PATENT DOCUMENTS

| | | | | |
|---|---|---|---|---|
| 6,918,709 | B2 * | 7/2005 | Takeuchi et al. | 400/662 |
| 7,441,849 | B2 * | 10/2008 | Sasa et al. | 347/8 |
| 7,490,931 | B2 * | 2/2009 | Hasebe et al. | 347/102 |
| 2003/0184631 | A1 * | 10/2003 | Suzuki et al. | 347/102 |
| 2003/0222960 | A1 * | 12/2003 | Takabayashi | 347/102 |
| 2006/0023024 | A1 * | 2/2006 | Niekawa | 347/37 |
| 2007/0070162 | A1 * | 3/2007 | Yokoyama | 347/102 |
| 2007/0076079 | A1 * | 4/2007 | Miura | 347/102 |
| 2007/0097195 | A1 * | 5/2007 | Nishino | 347/102 |

FOREIGN PATENT DOCUMENTS

| | | | |
|---|---|---|---|
| JP | 2004-255867 | | 9/2004 |
| JP | 2004-338264 | | 12/2004 |
| JP | 2004338264 A | * | 12/2004 |
| JP | 2005-103845 | | 4/2005 |

* cited by examiner

*Primary Examiner* — Matthew Luu
*Assistant Examiner* — Rut Patel
(74) *Attorney, Agent, or Firm* — Lucas & Mercanti, LLP

(57) ABSTRACT

Clogging of an ink-jetting opening is more reliably prevented, by inkjet recording apparatus 1 having recording heads 3*a*-3*d* each having an ink-jetting surface 30 in which an ink-jetting opening for jetting photo-curable ink toward a recording medium K is formed, light emitting devices 4 and 4 which emit light rays onto ink landed on the surface of recording medium K, platen 2 which supports recording medium K from its back side under a condition that recording medium K is faced to recording heads 3*a*-3*d* and light emitting devices 4 and 4, and box member 50 and 50 which prevent the light rays received from light emitting device 4 from reflecting toward ink-jetting surface 30, wherein box member 50 and 50 are placed at the side of recording medium K, and are closer to light emitting device 4 than the rear surface of recording medium K.

12 Claims, 4 Drawing Sheets

INKJET RECORDING APPARATUS AND INKJET RECORDING METHOD

This is a U.S. National Phase Application under 35 U.S.C. 371 of International Application PCT/JP2006/320170, filed on Oct. 10, 2006.

This Application claims the priority of Japanese Application No. 2005-299997, filed Oct. 14, 2005, the entire content of which is hereby incorporated by reference.

TECHNICAL FIELD

The present invention relates to an inkjet recording apparatus which records an image on a recording medium, and an inkjet recording method.

BACKGROUND OF THE ART

Recently, as apparatuses which record an image onto a recording medium having lower absorbability for ink, inkjet recording apparatuses employing a photo-curable method are used. In said inkjet recording apparatuses employing the photo-curable method, after photo-curable ink jetted from recording heads lands on the surface of a recording medium supported on a platen, the light rays are radiated from a light emitting device onto the ink so that the ink on the recording medium is hardened (See Patent Document 1).

As such photo-curable ink, well known are a radical polymerization system ink and a cationic polymerization system ink. Of these, since the cationic polymerization system ink accumulates the energy of the radiated light rays, said ink has a merit in which it is hardened by an illumination intensity which is lower than that of the radical polymerization system ink, whereby the cationic polymerization system ink has become the ink of choice in the various inkjet recording apparatuses.

However when the cationic polymerization system ink is used, if the distance between the light emitting device and a light receiving member such as a sheet of recording medium is relatively great, the light reflected from the light receiving member enters a jetting surface of the recording head, that is, it enters the surfaces of the an ink-jetting opening, whereby ink adhered on said jetting surfaces is hardened by the reflected light exhibiting the low illumination intensity so that the ink-jetting opening tends to become clogged, which may result in image defects.

In recent years to overcome this matter, on the inkjet recording apparatus using the ink being the cationic polymerization system, a plate member being the same height as said platen, is arranged on a radiating area at the side of the platen, so that the distance between the light receiving member and the light emitting device in said radiating area is shortened, whereby the light rays reflecting toward the ink-jetting surface are reduced.

Patent Document 1: Unexamined Japanese Patent Application Publication No. 2004-338264.

DISCLOSURE OF THE INVENTION

Problem to be Solved By the Invention

However, in the inkjet recording apparatus of the above described Patent Document 1, if the recording medium is relatively thick, said plate member at the side of the platen and the surface of the platen around the recording medium are placed farther from the light emitting device than the surface of the recording medium, whereby the light rays, reflected on the surface of the plate member and the surface of the platen, enter the ink-jetting surface, which results in a clogged ink-jetting opening.

The problem of the present invention is to provide an inkjet recording apparatus and an inkjet recording method, both of which can prevent the ink-jetting openings from being clogged, more effectively than conventional apparatuses.

Means to Solve the Problem (1) The invention is an inkjet recording apparatus, including:

a recording head which has an ink-jetting surface having ink-jetting openings to jet photo-curable ink toward a recording medium, at least one light emitting device which radiates light rays onto the ink landed on the recording medium, a carriage which drives said recording head and said light emitting device in a scanning direction, under a condition that said recording head and said light emitting device face said recording medium, a platen which supports a rear surface of said recording medium, under the condition that said recording head and said light emitting device face said recording medium, and a reflection preventing member which prevents light rays radiated from the light emitting device, from being reflected toward said ink-jetting surface, wherein said inkjet recording apparatus is characterized in that, in said scanning direction, said reflection preventing member is positioned at a side of said recording medium supported by said platen, and is placed closer to said light emitting device than the rear surface of said recording medium.

(2) The inkjet recording apparatus described in Item 1, above characterized in that said reflection preventing member is placed closer to said light emitting device than the front surface of said recording medium.

(3) The inkjet recording apparatus described in Items 1 or 2, above characterized in that surface finishing is conducted on the surface of said reflection preventing member, to prevent ink curable light component from being reflected toward said ink-jetting surface.

(4) The inkjet recording apparatus described in any one of Items 1 to 3, above characterized in that said platen includes a height adjusting mechanism which adjusts a height in a direction to move to or separate from said light emitting device, based on the thickness of said recording medium.

(5) The inkjet recording apparatus described in any one of Items 1 to 4, above characterized in that said scanning direction is parallel to a width direction of said recording medium, and a side edge section, being adjacent to the recording medium, of said reflection preventing member is movable in said direction to move to or separate from said light emitting device, based on the width of said recording medium.

(6) The invention is also an inkjet recording method, which includes the steps of:

supporting a rear surface of the recording medium on a platen, jetting ink onto the recording medium from an ink-jetting opening of a recording head having an ink-jetting surface on which said ink-jetting opening is provided, and emitting light rays from a light emitting device onto the photo-curable ink landed on a surface of said recording medium and curing said landed ink, wherein said inkjet recording method is characterized in that:

in the steps of jetting ink and emitting light rays, said recording head and said light emitting device are driven in a scanning direction under a condition that said recording head and said light emitting device face said recording medium, and said inkjet recording method is further characterized in that said inkjet recording method includes a step of placing a reflection preventing member at a side of said recording medium in said scanning direction, while said reflection preventing member, which prevents light rays received from said light emitting device from being reflected toward said ink-jetting surface, is placed closer to said light emitting device than the rear surface of said recording medium, at least before the step of emitting light rays.

(7) The inkjet recording method described in Item 6, above characterized in that in said step of placing the reflection preventing member, said reflection preventing member is placed closer to said light emitting device than the front surface of said recording medium.

(8) The inkjet recording method described in Items 6 or 7, above characterized in that in said step of placing the reflection preventing member, said member as the reflection preventing member is used, wherein surface finishing is conducted on the surface of the reflection preventing member to prevent an ink curable light component from being reflected toward said ink-jetting surface.

(9) The inkjet recording method described in any one of Items 6-8, above characterized to include a step of adjusting an altitudinal position of the platen in a direction to move to or separate from said light emitting device, based on the thickness of the recording medium.

(10) The inkjet recording method described in any one of Items 6-9, above characterized to include a step of placing a side edge, being adjacent to the recording medium, of said reflection preventing member, at a position adjacent to said recording medium, based on a width of said recording medium, in the step of placing said reflection preventing member, while said scanning direction is a width direction of said recording medium.

(11) The invention is also an inkjet recording apparatus, characterized to include:

a recording head which has an ink-jetting surface having ink-jetting openings to jet photo-curable ink toward a recording medium, at least one light emitting device which radiates light rays onto the ink landed on the recording medium, a carriage which drives said recording head and said light emitting device in a scanning direction, under a condition that said recording head and said light emitting device face said recording medium, a platen which includes a platen plate to support said recording medium from a rear surface, under the condition that said recording head and said light emitting device face said recording medium, and said platen further includes an adjusting mechanism to adjust the height in a direction of separating from said light emitting device, a reflection preventing member which is placed at both side edges of the platen to prevent light rays radiated from the light emitting device, from being reflected toward said ink-jetting surface, a thickness information obtaining means to obtain information of the thickness of said recording medium, and a control device which controls the adjusting mechanism included in said platen, based on said information of the thickness of said recording medium obtained by said thickness information obtaining means.

(12) The inkjet recording apparatus described in Item 11, above, including:

said reflection preventing member is formed of a box member and a plate member which can be protruded parallel to said platen plate, and the plate member is mounted on a top edge section of said box member, a driving means which moves a top section of said plate member in a direction to approach or separate from said recording medium, and a width information obtaining means which obtains information of the width of said recording medium, as well as said thickness information of said recording medium, said inkjet recording apparatus is characterized in that said control device controls said driving means to move said plate member toward said recording medium, based on said width information of the recording medium, obtained by said width information obtaining means.

Effects of the Invention

According to the invention described above, the ink existing at the ink-jetting surface is prevented from being hardened, so that the ink is more effectively prevented from clogging at the ink-jetting opening, than the conventional apparatus.

EXPLANATION OF NUMBERS

Figure 1:
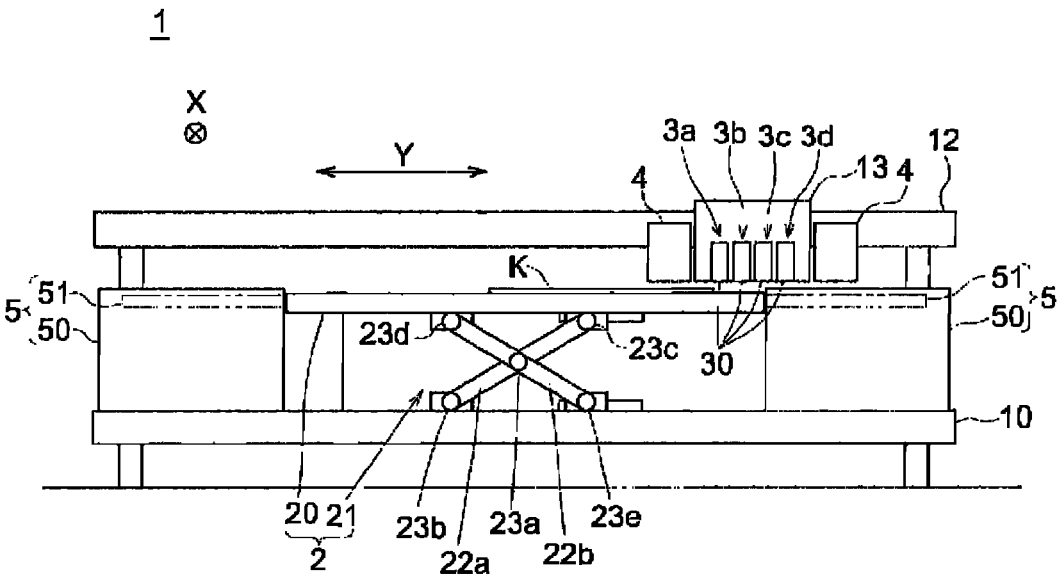
[FIG. 1] is a front view showing a schematic structure of the inkjet recording apparatus related to the present invention.

1 inkjet recording apparatus
3*a*-3*d* recording heads
4 light emitting device
5A reflection preventing member
50 box member (reflection preventing member)
51 plate member (reflection preventing member)
6 control device
13 carriage
30 ink-jetting surface
K recording medium
Y scanning direction (being a width direction of the recording medium)

BEST MODE FOR CARRYING OUT THE INVENTION

Embodiments of the present invention will be detailed below while referring to the drawings.

FIG. 1 is a front view showing a schematic structure of the inkjet recording apparatus related to the present invention.

As shown in this figure, inkjet recording apparatus 1 of the present embodiment is provided with platen 2 on supporting base 10.

Platen 2 provides a flat support for the rear surface of recording medium K (being a surface of a lower side in the figure), which includes adjusting mechanism 21 between platen plate 20 and supporting base 10.

Figure 2:
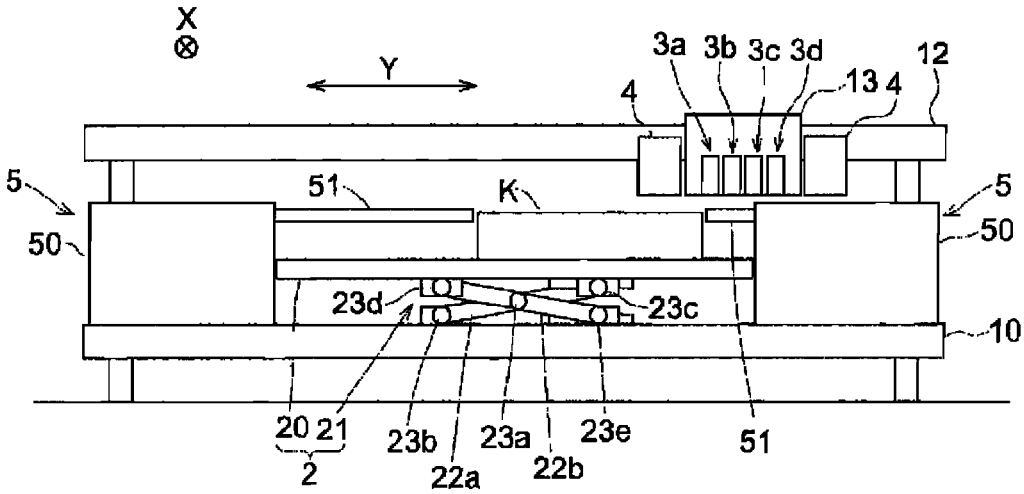
[FIG. 2] is a drawing explaining a condition in which the plate member is projected.

Said adjusting mechanism 21 adjusts the height of platen plate 20 so that the distance between the front surface of recording medium K and after-mentioned recording heads 3*a*-3*d* or light emitting device 4 can be adjusted to a prescribed distance. Further, recording medium K, as illustrated in FIG. 2, is thicker than that in FIG. 1.

In more detail, adjusting mechanism 21 is provided with two intersecting plate linked members 22*a* and 22*b*.

These linked members 22*a* and 22*b* are rotatably connected each other by pin 23*a* at center sections.

Further, one end of link member 22*a* is rotatably connected to supporting base 10 by pin 23*b*, while the other end of link member 22*a* is rotatably connected to platen plate 20 by pin 23*c*. Yet further, one end of link member 22*b* is rotatably connected to platen plate 20 by pin 23*d*, while the other end of link member 22*b* is rotatably connected to supporting base 10 by pin 23*e*.

Yet further, pins 23*c* and 23*e* are structured to be driven by drive motor 24 (see FIG. 3) in the horizontal direction, respectively along platen plate 20 and supporting base 10. When pins 23*c* and 23*e* are driven, said other ends of link members 22*a* and 22*b* slide on supporting base 10 and under platen plate 20, respectively. Accordingly, pins 23*c* and 23*e* are driven by said drive motor 24, so that platen 2 vertically moves platen plate 20.

Recording medium K, supported h platen 2 exhibiting the above described structure, is conveyed by conveyance roller 11 (see FIG. 3) in conveyance direction X (which means the depth direction of FIG. 1) In the present invention, conveyance direction X and the width direction (horizontal direction in FIG. 1) of recording medium K cross each other at right angles.

Above platen 2, guide member 12 is arranged in scanning direction Y which is parallel to the width direction of recording medium K, and carriage 13 is supported on guide member 12.

While being guided by guide member 12, carriage 13 can be reciprocated on recording medium K along guide member 12. Recording heads 3*a*-3*d*, being a total of four heads, are aligned on carriage 13 in scanning direction Y.

A plurality of ink-jetting openings (which are not illustrated) to jet photo-curable ink are provided on a lower surface 30 (hereinafter referred to as an "ink-jetting surface") of recording heads 3*a*-3*d*. In the present invention, ink-jetting opening of recording head 3*a* jets yellow ink, ink-jetting opening of recording head 3*b* jets magenta ink, ink-jetting opening of recording head 3*c* jets cyan ink, and ink-jetting opening of recording head 3*d* jets black ink.

At the both ends of carriage 13 in scanning direction Y, light emitting devices 4 and 4 are mounted.

Light emitting devices 4 and 4 radiate light rays onto the deposited ink droplets on recording medium K, both devices having an ultraviolet ray source (which is not illustrated) to emit ultra violet rays in the present invention. A fluorescent lamp, a laser, an LED, or an, electron ray emitting device may be used for said ultraviolet ray source.

Among the areas onto which the light rays are emitted by collaboration of light emitting devices 4 and 4, and carriage 13, reflection preventing members 5 and 5 are provided on the side of recording medium K in scanning direction Y, that is f reflection preventing members 5 and 5 are provided on the side areas of platen 2 in the present invention.

Reflection preventing member 5 prevents light rays received from light emitting device 4 from reflecting toward ink-jetting surfaces 30 of recording heads 3*a*-3*d*, and reflection preventing member 5 includes box member 50 and plate member 51, as the reflection preventing member of the present invention.

Box member 50 is mounted on supporting base 10. The surface (the upper surface in FIG. 1) of box member 50 is approximately parallel to the surface of platen plate 20, said surface is closer to light emitting device 4 than the rear surface of recording medium K, supported by said platen plate 20. In a preferable present embodiment, it is closer to light emitting device 4 than the front surface of recording medium K.

Plate member 51 is mounted on a top edge section of box member 50. Said plate member 51 can be protruded from box member 50 by drive motor 52 (see FIG. 3), moving back ward and forward and parallel to platen plate 20, whereby its top section is driven in a direction approaching or separating from recording medium K. Further, the surface (the upper surface in FIG. 2) of plate member 51 is approximately parallel to the surface of platen plate 20, said surface is closer to light emitting device 4 than the rear surface of recording medium K, supported by said platen plate 20. In the preferable present embodiment, the surface of plate member 51 is closer to light emitting device 4 than the front surface of recording medium K.

On the surfaces of box member 50 and plate member 51, surface finishing is conducted, which prevents light rays, which include an ink curable light components of the reflected light rays, from being reflected toward ink-jetting surfaces 30 of recording heads 3*a*-3*d*. Said surface finishing is not limited to a specific one, but which can, absorb ultraviolet rays or prevent their reflection. For example, black alumite paint, either black matte or semi-gloss can be used. Further, used is a corrugated surface, such as a wave-shaped surface, which absorbs or reduces ultraviolet rays emitted from light emitting device 4, or reflected ultraviolet rays.

Figure 3:
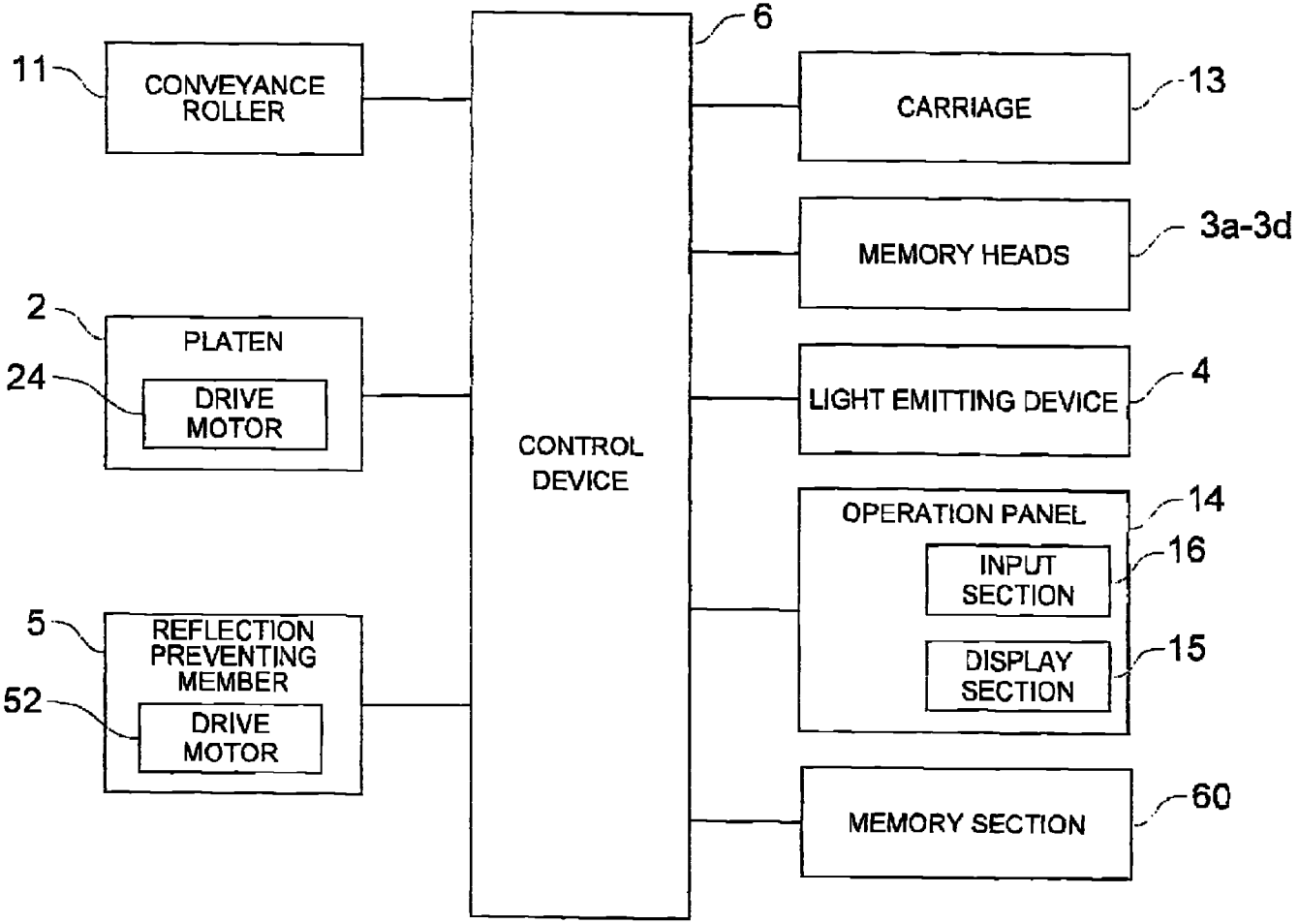
[FIG. 3] is a block diagram showing a schematic structure of the inkjet recording apparatus related to the present invention.

Control device 6 is connected to conveyance roller 11, recording heads 3*a*-3*d*, light emitting devices 4, platen 2, reflection preventing members 5, operation panel 14, memory section 60, and carriage 13, which are illustrated in FIG. 3 Control device 6, also structured of un-illustrated CPU, ROM and RAM, controls each section of inkjet recording apparatus 1. Said control device 6 is connected to operation panel 14 and memory section 60.

Operation panel 14 includes display section 15 and input section 16. Display section 15 is structured of a liquid crystal panel or the like, to display the current condition of inkjet recording apparatus 1, or the instruction to an operator. Input section 16 includes a plurality of input keys (which are not illustrated), by which the operator is able to input the type of recording medium K.

Memory section 60 is structured of a nonvolatile semiconductor memory or the like, to memorize the type of recording medium K, being corresponded to thickness and width.

"Ink" to be used in the present invention will now be detailed.

Concerning the ink usable in the present embodiment, such ink can be used that complies with the ink detailed in "Light Induction Type Alternating Copolymerization (section 2)" of "Light Curing System (chapter 4)" described in "Light Cure Technology —Selection and Compounding Condition of Resin+Initiator and the Measurement+Evaluation of the Degree of Cure (Information of Technical Association)", or the ink that can be cured by normal radical polymerization In detail, the ink usable in the present invention is one which has nature to be cured by the radiation of ultraviolet light rays, being an ultraviolet curable ink, which includes at least a polymerizable compound (including well-known polymerizable compounds), a light initiator, and a color material as main components. However, if the ink, complying with above-described "Light Induction Type Alternating Copolymerization (section 2)", is used, the light initiator may be excluded.

The above-described light curable ink can be classified as radical polymerizable type ink including a radical polimerizable compound as the polymerizable compound, and cation polymerizable type ink including a cation polymerizable compound. Both types of ink can be used for the present embodiment. Hybrid type ink in which said radical polymerizable ink and said cation polymerizable inc are compounded can also be used.

However, since the cation polymerizable type ink, which is rarely or not at all affected by polymerization reaction with oxygen, is superior for functionality and general versatility, cation polymerizable type ink is used in the present embodiment.

In addition, cation polymerizable type ink, used in the present embodiment, is a mixture including at least: cation polymerizable compounds; such as an oxetane compound, an epoxide compound, and a vinyl ether compound; an optical cation initiator; and a coloring material, wherein said cation polymerizable type ink is cured by ultraviolet rays, as described above.

The ink (which includes the radical polymerizable type ink, the cation polymerizable type ink and the hybrid type ink) used in the present embodiment is, as described above, curable by ultraviolet rays. However, said ink is not limited to the above types of ink, that is, any ink which is cured by light rays other than ultraviolet rays can be used. The term "light rays" here means light rays in the broad sense, including electromagnetic rays, such as ultraviolet rays, electron rays, X-rays, visible light rays, and infrared rays. That is, the ink used in the present embodiment is applicable to the polymerizable compound which can be cured by the light rays other than ultraviolet rays, and the optical initiator which starts the polymerization reaction of each polymerizable compound by the light rays other than ultraviolet rays. If such an ink, which is curable by light rays other than ultraviolet rays, is used in the present embodiment, a light emitting device which emits said light rays other than ultraviolet rays must of course also be employed.

"Recording medium K" used in the present embodiment will now be detailed.

Recording medium K usable in the present embodiment, includes various types of paper, such as normal paper, recycled paper, and glossy paper, various types of textiles, various types of non-woven fabric, resin, metal, and glass, all of which may be used in the normal inkjet recording apparatus. As to the configuration of recording medium K, a roll type, a cut sheet type, and a plate type are listed for use.

Specifically, as a recording medium K used in the present embodiment, soft packaging sheet can be used, which is a transparent or non-transparent non-hygroscopic resin film The types of resins used in the resin film are listed below: polyethylene terephthalate, polyester, polyolefin, polyamide, polyester amide, polyether, polyimide, polyamide-imide, polystyrene, polycarbonate, poly-p-phenylene sulfide, polyether ester, polyvinyl chloride, poly (meta) acrylic acid ester, polyethylene, polypropylene, and nylon. Further, a copolymer of the above resins, a mixture of the above resins, and the cross-linked resins of the above resins are also possible for use. Among them, as the types of resins used for the resin films, preferably used is any one of stretched polyethylene terephthalate, stretched polystyrene, stretched polypropylene, and stretched nylon. These are preferred because they exhibit excellent transparency, stable dimensionability, rigidity, low environmental load, and low cost. Further, a resin film at a thickness of 2-100μ is preferable for use (a thickness of 6-50μ is more preferable). Still further, surface treatment, such as a corona discharge treatment and a low adhesion treatment, is preferably conducted on the surface of supporting material of the resin film. Still further, for recording medium K used for the present embodiment, various types of paper, covered with resin, films including colorant, and non-transparent recording medium such as foamed film, can be used.

Next, the operation of inkjet recording apparatus 1 will be detailed, as the inkjet recording method relating to the present invention.

Figure 4:
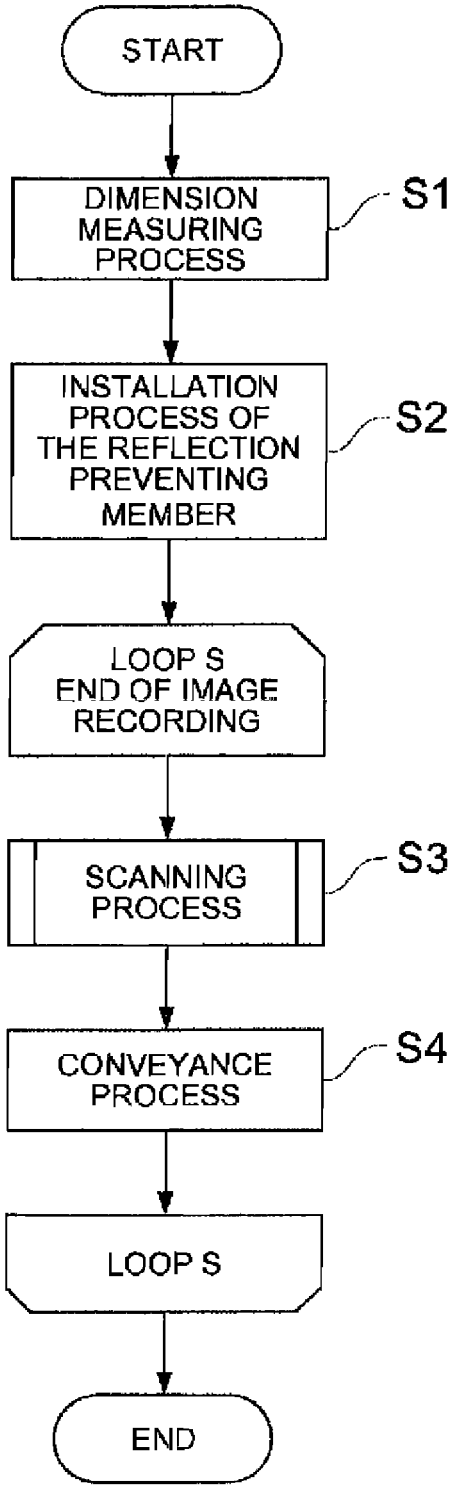
[FIGS. 4(*a*), 4(*b*)] are drawings showing the inkjet recording method related to the present invention.
Figure 4:
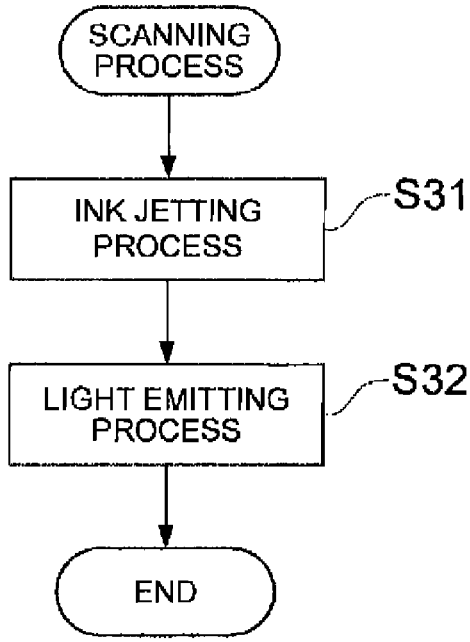

As shown in FIG. 4(*a*), after the operator inputs a type of recording medium K into input section 16, control section 6 obtains information of the thickness and width of recording medium K, based on the inputted type and information stored in memory section 60 (step S1: the dimension obtaining process).

Control section 6 controls platen plate 20 to vertically move so that the distance between recording medium K and recording heads 3*a*-3*d* or light emitting device 4 is adjusted to be the predetermined value, based on the thickness of recording medium K. Due to this adjustment, the distance between the surface of box member 50 of reflection preventing member 5 and light emitting device 4 becomes less than the distance between the surface of recording medium K and light emitting device 4.

Further, based on the thickness and width of recording medium K, when the thickness of recording medium K is greater than the thickness of plate member 51 of reflection preventing member 5, since the distance between the surface of platen plate 20 and light emitting device 4 is sufficiently greater than the thickness of plate member 51, said plate member 51 can be positioned closer to recording medium K (step S2: the reflection preventing member placing process). Due to this step platen plate 20, which is positioned away from light emitting device 4 than plate member 51, is shielded by said plate member 51.

In said step of placing the reflection preventing member, plate member 5', serving as the reflection preventing member, is placed adjacent to recording medium K. In the present invention, "adjacent to" means a position where plate member 51 comes as close to recording medium K as nearer as possible, while plate member 51 does not prevent the conveyance of recording medium K by adversely contacting recording medium K. Concrete numerical values cannot be completely determined, because said values depend on the shape of the edge of recording medium K, or the surface roughness of the edge of recording medium K, but it is generally 100μ-1 cm.

Next, under the condition in which the conveyance of recording medium K by conveyance roller 11 is stopped, carriage 13 scans one time along scanning direction Y directly on recording medium K (step S3: the scanning process) Due to this step, recording heads 3*a*-3*d* and light emitting device 4 face to scan recording medium K, following carriage 13.

During the step of scanning, as listed in FIG. 4(*b*), recording heads 3*a*-3*d* jet ink onto recording medium K (step S31: the ink-jetting process), and light emitting device 4, which are positioned at the rear side of recording heads 3*a*-3*d* in scanning direction Y, radiates ultraviolet rays onto the surface of recording medium K (step S32: the light rays emitting process), whereby immediately after said ink, jetted from each of recording heads 3a-3d, was landed, said ink is hardened, so that said ink is fixed on the surface of recording medium K.

In this case, regardless of the thickness of recording medium K, the distance between box member 50 of reflection preventing member 5 and light emitting device 4 is less than the distance between the surface of recording medium K and light emitting device 4. Accordingly, compared to conventional cases, in which the distance between the reflection preventing member and the light emitting device 4 is greater than the distance between the rear surface of recording medium K and light emitting device 4, light rays emitted from light emitting device 4 and reflected at the side of recording medium K, are prevented from entering ink-jetting surfaces 30 of recording heads 3a-3d.

Further, when the thickness of recording medium K is greater than the thickness of plate member 51 of reflection preventing member 5, plate member 51 is moved closer to recording medium K to shield platen plate 20 from stray light. Accordingly, regardless of the width of recording medium K, the light rays emitted from light emitting device 4, are prevented from entering platen plate 20 adjacent to the side of recording medium K.

Next, as shown in FIG. 4(a), conveyance roller 11 is driven so that recording medium K faces to carriage 13, and is conveyed at a predetermined length in conveyance direction X (step S4: the conveyance process).

After that, inkjet recording apparatus 1 repeats the processes of above steps S3-S4, whereby a desired image formed of plural dots of each process color, is sequentially recorded on the surface of recording medium K.

Based on the above-described inkjet recording method, since the light rays emitted from light emitting device 4 and reflected at the side of recording medium K, are prevented from entering ink-jetting surface 30 of recording heads 3a-3d by reflection preventing member 5. Accordingly, the ink on ink-jetting surface 30 is prevented from being hardened.

Further, when the thickness of recording medium K is greater than the thickness of plate member 51, the light rays emitted from light emitting device 4 are prevented from entering platen plate 20 near the side of recording medium K. That is, the light reflection on platen plate 20 is prevented. so that the ink can be steadily prevented from being hardened on ink-jetting surface 30.

Due to the above methods, the ink-jetting opening is more effectively prevented from clogging than those in conventional apparatus.

Additionally, the above-described embodiment teaches that control device 6 detects the dimensions of recording medium K, based on the type of recording medium K and information stored in memory section 60. However, it is also possible to detect the dimensions by the well-known dimension detection sensor.

Figure 5:
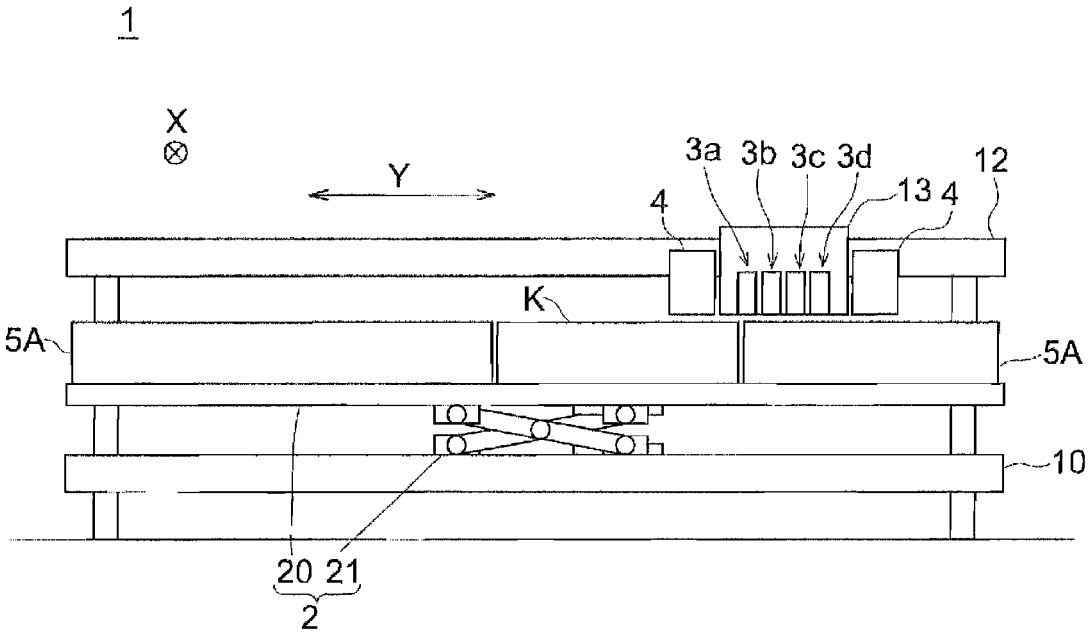
[FIG. 5] is a drawing showing another variation of the inkjet recording method related to the present invention

Further, the above-described embodiment teaches that platen plate 20 is vertically driven so that the distance between light emitting device 4 and the surface of box member 50 of reflection preventing member 5 became less than the distance between light emitting device 4 and the surface of recording medium K. However, it is also possible to construct the embodiment in such a way that, as shown in FIG. 5, reflection preventing member BA, which is thicker than recording medium K, is prepared for various types of recording media K, which member 5A can cover upper surfaces of platen plate 20, wherein said surfaces include the surfaces other than the area to support recording medium K. Then, corresponding to the type of recording medium K being used, reflection preventing members 5A for said type are placed on platen plate 20.

The invention claimed is:

1. An inkjet recording apparatus, comprising:

a recording head which has an ink-jetting surface having an ink-jetting opening to jet photo-curable ink toward a recording medium;

at least one light emitting device which radiates light rays onto the ink landed on the recording medium;

a carriage which drives the recording head and the light emitting device in a scanning direction, under a condition that the recording head and the light emitting device face the recording medium;

a platen which supports the recording medium from a rear surface of the recording medium, under the condition that the recording head and the light emitting device face the recording medium; and a reflection preventing member which prevents light rays radiated from the light emitting device, from being reflected toward the ink-jetting surface, wherein in the scanning direction, the reflection preventing member is positioned at a side of the recording medium supported by the platen, and is placed vertically closer to the light emitting device than the rear surface of the recording medium.

2. The inkjet recording apparatus of claim 1 wherein the reflection preventing member is placed vertically closer to the light emitting device than the front surface of the recording medium.

3. The inkjet recording apparatus of claim 1, wherein surface finishing is conducted on the surface of the reflection preventing member, to prevent an ink curable light component from being reflected toward the ink-jetting surface.

4. The inkjet recording apparatus of claim 1 wherein the platen includes a height adjusting mechanism which adjusts a height in a vertical direction to move toward or separate from the light emitting device, based on the thickness of the recording medium.

5. The inkjet recording apparatus of claim 1 wherein the scanning direction is parallel to a width direction of the recording medium, and a side edge section, being adjacent to the recording medium, of the reflection preventing member is movable in a horizontal direction to move toward or separate from the recording medium, based on the width of the recording medium.

6. An inkjet recording method, comprising steps of:

supporting a recording medium from a rear surface of the recording medium on a platen;

jetting ink onto the recording medium from an ink-jetting opening of an ink-jetting surface of a recording head; and emitting light rays from a light emitting device onto the photo-curable ink landed on a surface of the recording medium to cure the landed ink, wherein in the steps of jetting ink and emitting light rays, the recording head and the light emitting device are driven in a scanning direction under a condition that the recording head and the light emitting device face the recording medium, and the inkjet recording method includes a step of placing a reflection preventing member at a side of the recording medium in the scanning direction, while the reflection preventing member, which prevents light rays received from the light emitting device from being reflected toward the ink-jetting surface, is placed vertically closer to the light emitting device than the rear surface of the recording medium, at least before the step of emitting light rays.

7. The inkjet recording method described of claim 6 wherein in the step of placing the reflection preventing member, the reflection preventing member is placed vertically closer to the light emitting device than the front surface of the recording medium.

8. The inkjet recording method of claim 6 wherein in the step of placing the reflection preventing member, a surface finishing is conducted on the surface of the reflection preventing member, to prevent an ink curable light component from being reflected toward the ink-jetting surface.

9. The inkjet recording method of claim 6 further comprising a step of adjusting a vertical position of the platen in a vertical direction to move toward or separate from the light emitting device, based on the thickness of the recording medium.

10. The inkjet recording method of claim 6 further comprising a step of placing a side edge, being adjacent to the recording medium, of the reflection preventing member, at a position adjacent the recording medium, based on a width of the recording medium, in the step of placing the reflection preventing member, while the scanning direction is a width direction of the recording medium.

11. An inkjet recording apparatus comprising:

a recording head which has an ink-jetting surface having ink-jetting openings to jet photo-curable ink toward a recording medium;

at least one light emitting device which radiates light rays onto the photo-curable ink landed on the recording medium;

a carriage which drives the recording head and the light emitting device in a scanning direction, under a condition that the recording head and the light emitting device face the recording medium;

a platen which includes a platen plate to support the recording medium from a rear surface of the recording medium, under the condition that the recording head and the light emitting device face the recording medium, and the platen further includes an adjusting mechanism to adjust the height in a vertical direction to move toward or separate from the light emitting device;

a reflection preventing member which is placed at both side edges of the platen to prevent light rays radiated from the light emitting device, from being reflected toward the ink-jetting surface, the reflection preventing member is positioned vertically closer to the light emitting device than the rear surface of the recording medium;

a thickness information obtaining section to obtain information of the thickness of the recording medium; and a control device which controls the adjusting mechanism included in the platen, based on the information of the thickness of the recording medium obtained by the thickness information obtaining section.

12. The inkjet recording apparatus of claim 11, wherein:

the reflection preventing member is formed of a box member and a plate member which can be protruded parallel to the platen plate, and the plate member is mounted on a top edge section of said box member; and the inkjet recording apparatus further comprises:

a driving section which moves a top section of the plate member in a horizontal direction to approach or separate from the recording medium; and a width information obtaining section which obtains information of the width of the recording medium, wherein the control device controls the driving section to move the plate member toward the recording medium, based on the width information of the recording medium, obtained by the width information obtaining section.

* * * * *